United States Patent [19]

Shaw

[11] Patent Number: 4,836,379

[45] Date of Patent: Jun. 6, 1989

[54] MODULAR SHOCK-ABSORBING SHIPPING PACK

[76] Inventor: William H. Shaw, 12 Jersey La., Manchester, Mass. 01944

[21] Appl. No.: 71,278

[22] Filed: Jul. 8, 1987

[51] Int. Cl.[4] ..... B65D 85/030

[52] U.S. Cl. ..... 206/523; 206/453; 206/586; 206/591

[58] Field of Search ..... 206/453, 523, 586, 584, 206/585, 591, 597, 583; 217/66

[56] References Cited

U.S. PATENT DOCUMENTS

| | | | |
|---|---|---|---|
| 1,921,228 | 8/1933 | Hetherington | 206/585 |
| 2,004,626 | 6/1935 | Hann | 206/453 |
| 2,064,383 | 12/1936 | Porter | 206/597 |
| 2,331,585 | 10/1943 | Walker | 206/453 |
| 3,104,085 | 9/1963 | Skladany | 206/597 |
| 3,203,726 | 8/1965 | Smith | 206/453 |
| 3,314,584 | 4/1967 | Knapp et al. | 206/591 |
| 3,356,209 | 12/1967 | Pezely | 206/46 |
| 3,404,826 | 10/1968 | Carmody | 206/591 |
| 3,482,759 | 12/1969 | Ortiz | 206/453 |
| 3,520,769 | 7/1970 | Baker | 206/453 |
| 3,546,055 | 12/1970 | Spertus | 206/523 |
| 3,645,387 | 2/1972 | Hunt | 206/453 |
| 3,720,035 | 3/1973 | Rutter | 206/453 |
| 3,896,930 | 7/1975 | Collin | 206/523 |
| 3,973,720 | 8/1976 | Schmid | 206/523 |
| 3,994,433 | 11/1976 | Jenkins et al. | 206/523 |
| 4,122,946 | 10/1978 | Holly | 206/523 |
| 4,287,265 | 9/1981 | McKnight | 206/586 |
| 4,413,735 | 11/1983 | Little | 206/523 |
| 4,482,054 | 11/1984 | Gardner | 206/586 |
| 4,602,715 | 7/1986 | Sarver et al. | 206/591 |

OTHER PUBLICATIONS

"UNIPACK®-Protective Packaging Corner Block Selection Guide" published on or about 1970 by United Foam Plastics Corporation

*Primary Examiner*—David T. Fidei

*Attorney, Agent, or Firm*—Lahive & Cockfield

[57] ABSTRACT

A packing device for protecting an item housed in a container essentially consisting of a plurality of shock absorbing elements, each having an integral recess along one of its sides, and a loop of stretchable elastomeric cord which frictionally interfits within the recess. Preferably, the cushioning elements are of a resilient and non-abrasive foam material adapted and configured to be removably snap-fitted onto the cord at desired positions. In use, and depending on the desired packaging configuration, the cord with the cushioning elements attached is stretched either about an item to be shipped within a single container, or about an inner container which is then snugly fitted (i.e., with a tight fit) within an outer container. The invention can also be practiced by placing the device about an item or container to be shipped, and not employing additional outside packaging about the mounted packing device.

13 Claims, 3 Drawing Sheets

MODULAR SHOCK-ABSORBING SHIPPING PACK

BACKGROUND OF THE INVENTION

1. Field of the Invention

The invention relates to shock absorbing devices used in packing containers for protecting objects during shipment.

2. Description Of The Prior Art

Fragile or breakable objects are frequently packed or packaged in special shock-absorbent materials, such as polyethylene foam or other expanded plastics. These materials are generally light in weight, non-abrasive and highly shock-absorbent; consequently affording excellent protection against breakage or damage during shipment.

Packing devices of this type can be used to protect articles, equipment, or other objects of various sizes, weights and fragilities. Typically, the object is placed in an inner container. The inner container is then placed in a larger container, and shock-absorbent materials or devices are interposed between the outer surface of the inner container and the inner surface of the outer container. Alternatively, in conventional packing arrangements, the object itself is suitably cushioned and placed in a suitable container. Packing materials and devices play an important role since transported items such as computers and electronic instruments must arrive at their ultimate destination undamaged, either in terms of function or of aesthetic appearance.

Heretofore, shock absorbent material has taken various forms including shredded or wadded plastic chips, foam blocks, or pre-formed structures.

These approaches have proven themselves not entirely satisfactory. A great volume of plastic chips is required to fill the void between the inner and outer containers. Foam blocks require accurate placement by the packer. Pre-formed structures must be specifically designed and fabricated to snugly fit the contours of the object to be protected and, therefore, are not adaptable or reuseable to protect articles of a different shape or size.

Because of these shortcomings, various shock absorbent devices have been proposed because of their supposed cost savings, adaptability, reuseability and/or ease in use.

The modular packaging taught by U.S. Pat. No. 3,356,209 to Pezely and U.S. Pat. No. 4,287,265 to McKnight achieve many of the advantages of a custom molded, pre-formed structure while at the same time obtaining reuseability and interchangeability. The packaging can be used to protect objects of various shapes and sizes. The packaging included foam plastic, shock absorbing blocks removably positioned in holes within supporting panels. Each of the panels can be folded, for example, into a corner configuration to fit about corners of the object to be protected. The packaging is reusable as well as adaptable to different objects to be shipped. Precise placement in the container and disassembly requirements for storage, however, may be viewed as its shortcomings.

U.S. Pat. No. 3,546,055 to Spertus teaches the use of a plurality of foam balls (with or without a less expensive filler material) joined together in spaced relationship along a flexible cord or sheet so as to form strands or mats, respectively. These are placed in a shipping carton in a fashion similar to plastic chips, as described above, though are more convenient for the packer to handle. The foam balls are apparently formed and joined to the cord or sheet by the application of heat.

A foam cushioning pad is taught by U.S. Pat. No. 3,973,720 as being foldable to protect side surfaces or exposed corners of an object being shipped. According to one embodiment, the pad includes "T" shaped apertures for receiving a flat type packing band therethrough. The packing band is employed, for example, to secure a plurality of the pads about an object to be protected. For assembly, the band is laced through two of the apertures in each of the pads. Since bands of this type are generally not reused, a new one and a repetition of the assembly steps is apparently required for each shipment.

Accordingly, an object of the invention is to provide a reusable packing device of universal construction which may be adapted to protect items of various weights, sizes and fragilities.

It is another object of the invention to provide a packing device which is inexpensive in terms of materials, shipping, and storage, and which is easy to assemble, disassemble and fit about an item to be protected during shipment.

SUMMARY OF THE INVENTION

These and other objects of the invention are achieved by a packing device for protecting an item housed in a container essentially consisting of a plurality of shock absorbing elements, each having an integral recess along one of its sides, and a loop of stretchable elastomeric cord which frictionally interfits within the recess. Preferably, the cushioning elements are of a resilient and non-abrasive foam material adapted and configured to be removably snap-fitted onto the cord at desired positions. In use, and depending on the desired packaging configuration, the cord with the cushioning elements attached is stretched either about an item to be shipped within a single container, or about an inner container which is then snugly fitted (i.e., with a tight fit) within an outer container. The invention can also be practiced by placing the device about an item or container to be shipped, and not employing additional outside packaging about the mounted packing device.

According to one aspect of the invention the cushioning elements of the packing device are fashioned into side blocks, and edge straddling and corner receiving configurations to better conform to and protect the surfaces, edges and corners of the inner container. A plurality of specifically configured packing devices comprising cushioning elements of these configurations disposed on a plurality of cords are utilized as needed to protect the inner container.

According to another aspect of the invention, each shock absorbing element comprises resilient material preferably of a laminated construction of at least two polymeric foam materials of differing densities. This construction improves the shock absorbing characteristics of the cushioning elements.

The invention will next be described in connection with certain illustrative embodiments. However, it should be appreciated that various changes, modifications and additions can be made by those skilled in the art without departing from the scope of the invention as defined in the claims.

BRIEF DESCRIPTION OF THE DRAWINGS

For a fuller understanding of the features, advantages and objects of the invention, reference should be made to the following detailed description and the accompanying drawings; in which.

DETAILED DESCRIPTION OF THE INVENTION

Figure 1:
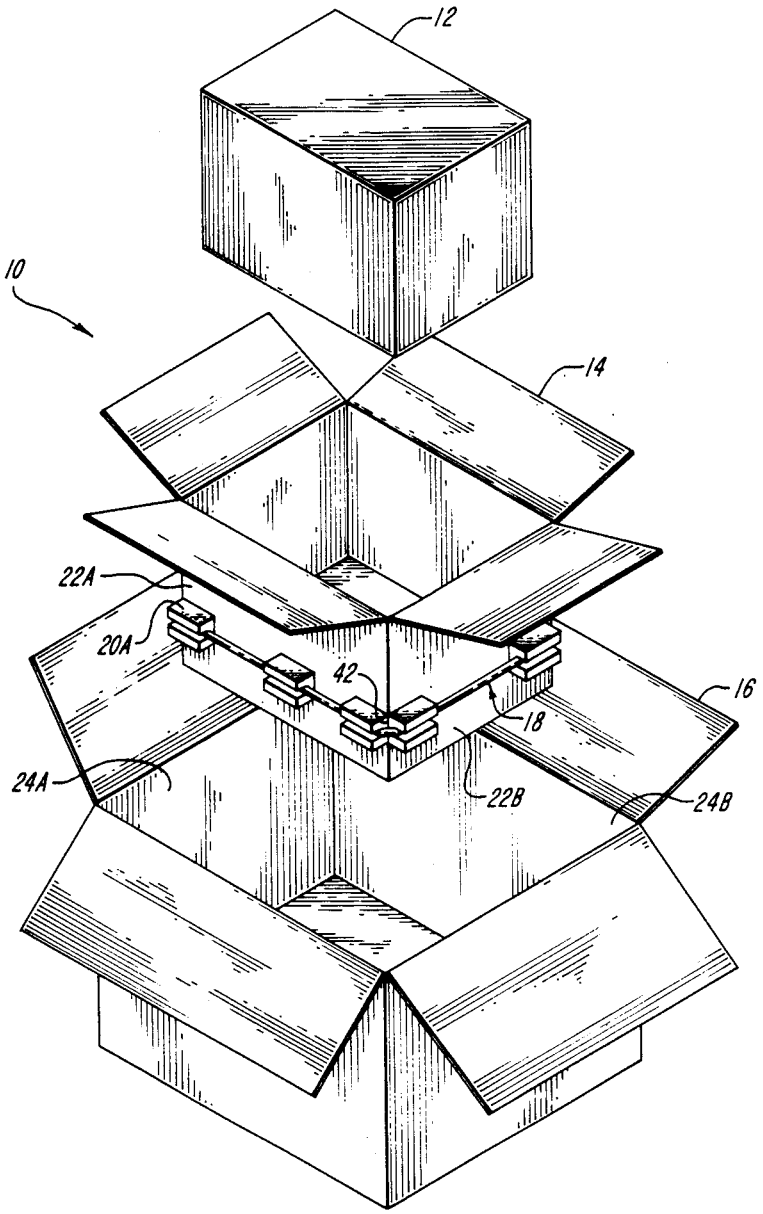
FIG. 1 is an exploded, perspective view of an illustrative shipping container arrangement incorporating a shipping pack comprising a side module according to the invention.

Referring now in detail to the drawings, wherein like reference characters designate like or corresponding parts, shown in FIG. 1 is an illustrative shipping arrangement 10 incorporating a shipping pack according to the invention.

The shipping arrangement 10 comprises an object 12 which is placed during shipment in an inner container 14 which after being closed is, in turn, placed within an outer container 16. As shown, the inner and outer containers 14, 16 are corrugated cardboard boxes. Their specific nature and construction does not constitute part of the invention. The inner container 14 is protected by a shipping pack 18 which encircles it along its outer surface and protrudes outwardly therefrom. The shipping pack 18 is elastically secured to the inner container 14. After assembly of the inner container 14 (as thus protected) into the outer container 16, the shipping pack 18 is disposed so as to resiliently deform in response to any compressive force imparted thereto from the outer container 16 due to impact, and thereby to cushion or isolate the inner container 14 from the compressive force. Though only a single shipping pack is shown in FIG. 1, it will be appreciated that, in practice, several shipping packs are preferably used to protect the many surfaces, edges and corners of inner container 14, as more fully described hereinbelow.

The shipping pack 18 in accordance with the invention can be used to protect objects, whether they are articles, equipment, or containers of one or more items, packaged for shipment or transportation. The shipping arrangement shown in FIG. 1 depicts but one foreseeable use of the shipping pack. Alternative arrangements include, for example, the use of a shipping pack to more directly protect object 12 by enwrapping it in a similar fashion within inner container 14 or the packing of several, similarly protected inner containers within a single outer container. Another alternative arrangement is the protection of the object 12 (e.g., a computer, stereo receiver, or other equipment) through the use of a shipping pack or packs disposed about the object prior to it being packaged in its container. Thus, the invention can be practiced in other than double packaging arrangements, where only a single container is employed, perhaps with cardboard partitions therebetween. Yet another arrangement is the use of the shipping packs about the object 12 or about a container, without employing additional packaging, such as an outer container, about the mounted shipping pack. This arrangement would find particular utility, for example, in the shipment of larger palletized items. Furthermore, inner and outer containers of configurations other than box like, such as barrels or designer packaging can likewise be used. These and other variations of the shipping arrangement will be understood and can be implemented by one skilled in the art without further description or illustration, and are within the purview of the invention.

The shipping pack 18 comprises a side module 20A encircling the inner container 14 about its outer side surfaces, of which two are shown, designated 22A, 22B. In use, the inner container 14 housing the object 12 and protected by the side module 20A is placed within the outer container 16. The sizes of the inner and outer containers 14, 16 and the side module 20A are selected so that the inner container 14, so protected, fits snugly within the outer container 16. As such, the side module 20A will normally contact or nearly contact the inner side surfaces of the outer container 16, of which inner side surfaces 24A and 24B are shown.

The shipping pack according to the invention, including various configurations and variations thereof, shall now be described in further detail.

Figure 2:
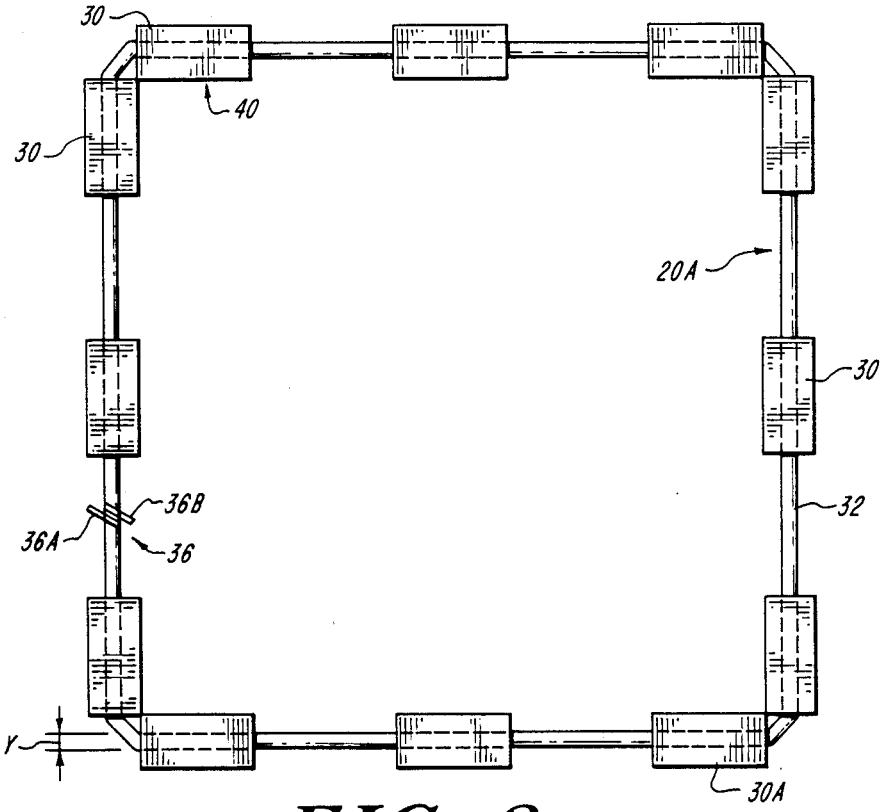
FIG. 2 is a top plan view of a shipping pack comprising a side module according to the invention.
Figure 3:
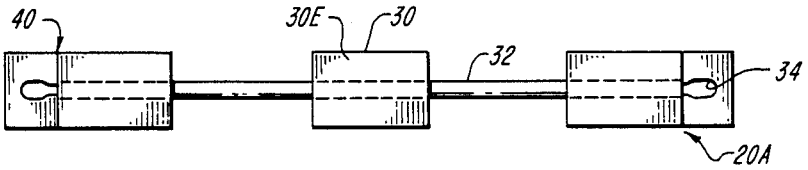
FIG. 3 is a side elevational view of the side module shown in FIG. 2.

There is shown in FIGS. 2 and 3, respectively, an illustration of a top and side view of a side module 20A of the shipping pack 18 of the present invention. The side module 20A includes a plurality of cushioning elements consisting of side blocks 30, made of resilient material which are removably fitted in spaced-apart relation on a continuous loop of stretchable cord 32 of elastomeric material with a cross section (preferrably, a circular cross section) characterized by a diameter "v", which interconnects a series of side blocks 30.

Figure 4:
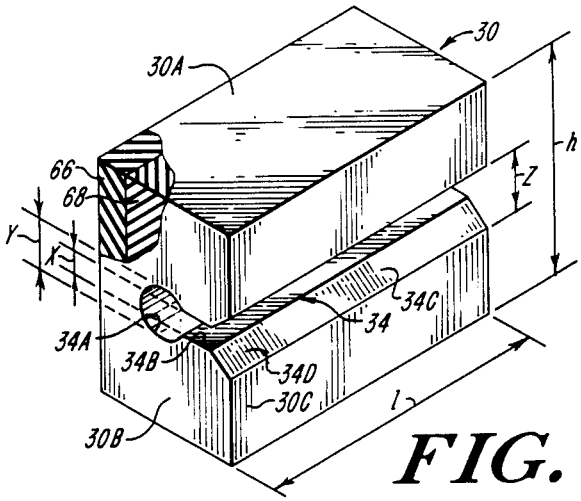
FIG. 4 is a perspective view, partially cut away, showing the top, side and front of a shock absorbing element according to the invention.

Each side block 30, as shown in perspective in FIG. 4, has a generally rectangular cross section. It includes a top surface 30A, a bottom surface (not shown) being a mirror image of the top surface 30A and in spaced parallel relationship thereto, two parallel and spaced side surfaces of which side surface 30B is shown in this figure (the other side surface 30C being the mirror image thereof and shown in FIG. 7), the side surfaces bridging orthogonally between top surface 30A and the bottom surface, a front surface 30D, and a back surface 30E (shown in FIG. 2) parallel to the front surface 30D, the front and back surfaces 30D, 30E bridging orthogonally between the other surfaces. The surfaces just described are generally of planar and rectangular form.

The front surface 30C has an integral recess along its entire length, which is designated "1", between side surfaces 30B, 30C into which the elastomeric cord 32 (FIG. 2) frictionally interfits. The recess 34 preferably is located midway along the height dimension, designated "h", of the front surface 30C. Other than the recess 34, side block 30 is of a solid geometry.

The recess 34 includes a central portion 34A of circular cross section having a diameter "y", a restriction 34B having an opening of height "x" (in a direction parallel to that along which "h" is measured) less than the cross-sectional diameter "y" of central portion 34A, and a flared portion 34C defined by outwardly extending surfaces 34D which define an opening having its greatest height (designated "z") distal from restriction 34B for facilitated mounting of side block 30 on elastomeric cord 32.

With continued reference to FIGS. 2–4, during mounting of the side block 30 on the elastomeric cord 32, the cord 32 is received within the flared portion 34C and, as it is pushed further, deforms the material comprising the restriction 34B and/or is deformed by restriction 34B, and finally enters distal portion 34A and thus assumes its fully assembled position. The restriction 34B prevents unintentional disassembly of the side module 20A from the cord 32.

Alternatively and preferably, the assembly is achieved by manually stretching the cord 32 locally in the vicinity of the side block 30 to be mounted thereon. As a practical matter, the cord 32 should exhibit resilient elongation during stretching of at least twenty (20%) percent, and, preferably, one hundred (100%) percent or more. On stretching, the diameter of cord 32 is reduced enabling it to be easily passed through the restriction 34B. To enable this approach to assembly, the dimensions of the side block 30 and cord 32 are such that dimension x of the restriction 34B is less than diameter "y" of the central portion 34A which, in turn, is less than dimension "z" of the flared portion 34C. Further, diameter "v" when the cord is stretched is preferably less than dimension "x" of the restriction 34B and, when not stretched, is equal to or slightly greater than diameter "y" of the central portion 34A.

Thus, the elastomeric cord 32 interfits, preferably frictionally, into the central portion 34A of recess 34, and the block 30 easily snaps on and off the cord 32 and can be retained in place along the length of the cord 32 as desired.

The elastomeric cord 32 which interconnects the side blocks 30 is formed of a continuous or endless loop. One skilled in the art will recognize that the cord 32 can be formed into a loop by suitable molding techniques so as to fashion an integral loop or by using fastening means 36 as shown in FIG. 2. Fastening means 36 releasably interconnects the ends of the elastomeric cord 32, permitting them to be disconnected and selectively adjusted in length so that it can accommodate various sizes of the object to be protected. The fastening means 36 comprises, for example, Velcro brand fastening material having pads 36A and 36B of integral hooks and loops.

After assembly of the side blocks 20 on the looped elastomeric cord 32 and the cord 32 on the inner container 14 (FIG. 1), the flared portion 34C preferrably faces radially outwardly and away from the inner container as shown in FIG. 1, or faces radially inwardly and towards the inner container 14, as can be appreciated from FIGS. 2 and 3. In the latter orientation, when the cord 32 has been stretched about the inner container 14, the restriction 34B serves to prevent disassembly of the side block 30 from the cord 32 while the cord's elastic material's restoring forces cause the loop to elastically collapse towards the inner container 14.

According to a further aspect of the invention and as shown in FIGS. 2 and 3, the cushioning elements of the side module 20 may further include side edge-straddling units 40. Each essentially consists of two side blocks 30 joined along an edge 42 (FIG. 1) of height "h" distal from the flared portion 34C of the recess 14. The two side blocks 30 are in a perpendicular arrangement for placement along adjoining and perpendicular side surfaces of the inner container 14 (FIG. 1) and fitting over or straddling the included edge thereof. Side blocks 30 can be added or omitted between edge-straddling units 40 as needed for varying cushioning requirements. The side blocks 30 from which the edge-straddling units 40 are comprised can be joined during their fabrication or by subsequent application of an adhesive. Alternatively, the two side blocks can be situated in a contacting or nearly contacting position and held in the position frictionally by the elastomeric cord 32.

Figure 5:
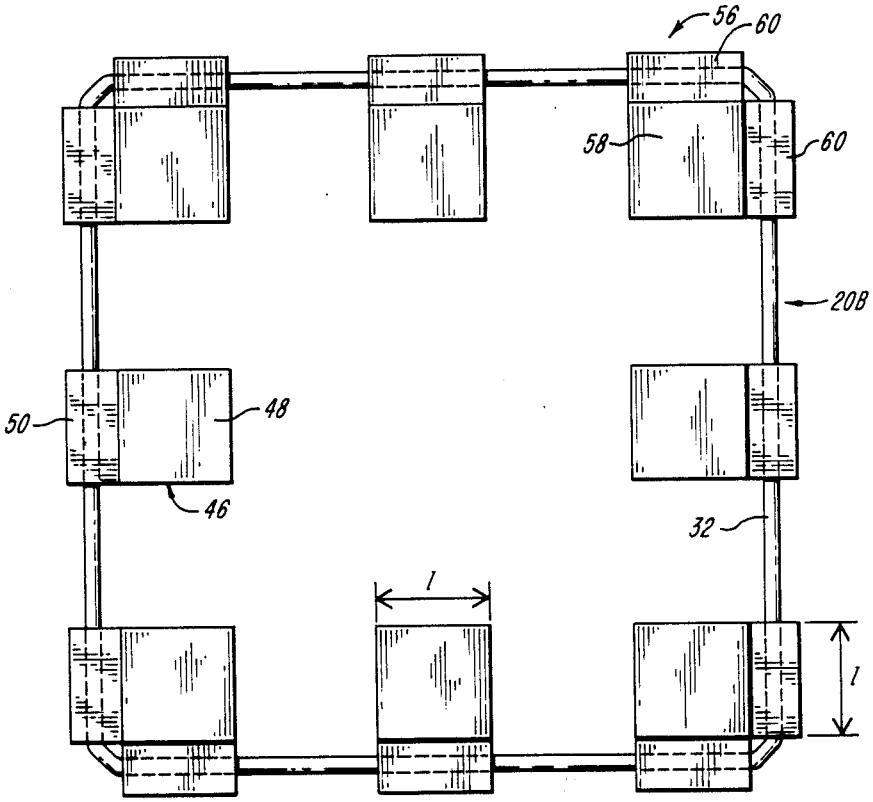
FIG. 5 is a top plan view of a top module of the shipping pack of the present invention, a bottom module of the shipping pack being the mirror image thereof.
Figure 6:
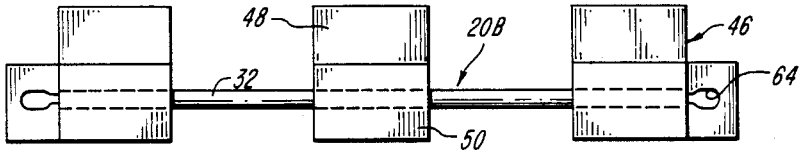
FIG. 6 is a side elevational view of the shipping pack shown in FIG. 5.

Other configurations of the cushioning elements are shown in FIGS. 5 and 6. These show the top plan view and side elevational view of a top module 20B of the shipping pack 18 made in accordance with the present invention. The side module 20A and top module 20B are also shown in perspective in FIG. 6, as is bottom module 20C. It will be understood that since a bottom module 20C (see FIG. 7) of the shipping pack 18 is a mirror-image of the top module 20B, FIGS. 5 and 6 could as easily be referred to as a bottom and side view of a bottom module 20C.

The top and bottom modules 20B, 20C are essentially of similar construction and intended for placement about the top surface's edges and bottom surface's edges, respectively, of the inner container 14 (FIG. 1) after it is closed with its flaps folded inwardly. Thus, these modules protect the surfaces, and included corners and edges from impact during shipping and handling.

The top module 20B preferably includes a plurality of top edge straddling units 46. Each essentially consists of an orthogonal top panel 48 in perpendicular arrangement with a block 50 of construction similar to side block 30 so as to form an "L" shaped interior cavity 52 (FIG. 7) which fits over or straddles a top, right-angled edge of the top surface of the inner container. Top panel 48 and block 50 are connected edgewise so as to form a join of length "1" along one of their respective edges parallel to an integral recess 54 of similar configuration and disposition to integral recess 34 in block 30. Recess 54 in block 50 is located along a surface of the block 50 contiguous with or remote from the interior cavity 52, as will be appreciated from the discussion hereinabove. Additional top edge straddling units 46 can be added onto cord 32 as needed for varying cushioning requirements.

The top module 20B further includes a plurality of corner receiving units 56 each of which essentially consists of a top panel 58 having two blocks 60 extending perpendicularly from adjoining edges thereof, each having a length "1". The blocks 60 are disposed and configured relative to one another in a fashion similar to the blocks 30 forming side edge straddling units 40, and are each disposed and configured relative to the top panel 58 in a fashion similar to the top edge straddling units 46. As so constructed, the top panel 58 and blocks 60 together define an interior cavity 62 (FIG. 7) which is sized and configured to receive an exterior right angled corner of the box-like inner container 14 (FIG. 1). Integral recesses 64 in blocks 60 are each similar to integral recess 54 and are disposed either contiguous with or remote from interior cavity 62, as again will be appreciated from the discussion hereinabove.

It can be understood from the foregoing description that the invention is module in nature. Blocks 20, 50 and 60 are of similar construction. Top panels 48 and 58 are also of similar construction. The number of cushioning elements used to protect the inner container can be adjusted in accordance with the size, weight and fragility of its contents. Other combinations of similarly constructed parts can be used to protect containers of other shapes, as will be apparent to one skilled in the art.

Figure 7:
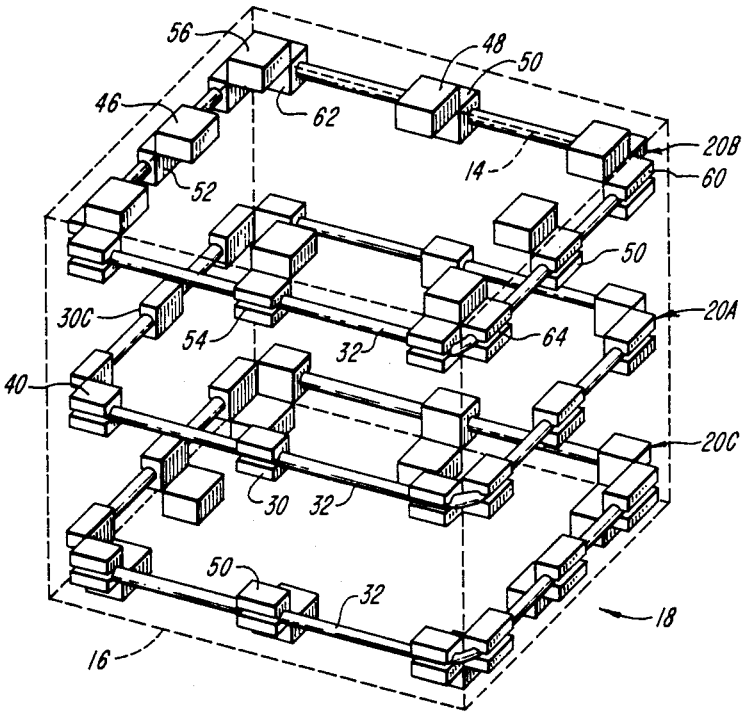
FIG. 7 is an illustration of an exemplary use of the top, bottom and side modules of the shipping pack according to the invention, in a double packaging arrangement with an inner and outer container shown in phantom.

One exemplary use of the shipping pack 18 made in accordance with the invention is depicted in FIG. 7 which illustrates, partially in phantom, a "double-package" arrangement. Specifically, the side, top, bottom modules 20A, 20B, 20C which form the shipping pack 18 of the present invention are fitted about the sides, top and bottom of the inner container 14, represented in phantom. The inner container 14 is disposed in an outer container 16 also represented in phantom so that the shipping pack 18 is disposed between the inner and outer containers 14, 16.

As shown in FIG. 7, the four corner receiving units 56 of each of the top and bottom modules 20B, 20C fit over the corners of the inner container 14. In place along each of the elastomeric cords 32 and alternating between the corner receiving units 56 are four top and bottom edge straddling units 46 which fit the top and bottom edges (four on each) of the inner container 14. The number of top and bottom edge straddling units 46 can be varied depending on the cushioning requirements, as discussed hereinbelow. The side module 20A consist of four side edge straddling units 40 which matingly interfit over the outer side edges of the inner container 14. Four side blocks 30 are located between side edge straddling units 40. More can be used as needed for varying cushioning requirements.

The shipping pack 18 is intended to be sold in a variety of different kits to meet anticipated purchasing needs. For example, the side, top and bottom modules 20A, 20B, and 20C shown in FIG. 6, and described in the preceding paragraph, can together be sold as a kit, or each module can be sold separately.

The cushioning elements of the invention are made of shock absorbent, resilient and non-abrasive material. Foamed plastic materials such as polyolefin, polyurethane, and other types of foamed polymers, both of the open-cell and closed-cell variety are preferred. Generally, such foam plastic materials exhibit the numerous advantages for use in shipping packs since they are lightweight, relatively inexpensive, supplied in a variety of densities, shatter resistant, engineered to resist breakage and crumbling when flexed, cut, or struck, and resistant to chemical attack. Furthermore, they maintain these properties over a broad range of adverse environmental and temperature conditions. Since they are non-abrasive, they are suitable for protecting painted or delicately finished objects.

According to a further aspect of the invention, the cushioning elements of the invention are laminated, comprising layers of a plurality of foamed polymeric materials having differing densities which exhibit synergistic cushioning properties, as described in co-pending U.S. Application Ser. No. 932,652, filed Nov. 18, 1986, the specification of which being incorporated, herein. As shown in FIG. 4, the side block 30 preferably comprises a layer 66 having a first polymeric foam material characterized by a first density and adhered to a layer 68 having a second polymeric foam material characterized by a second density different from the first. As can readily be understood by one in the art, blocks 50, 60, and top panels 48, 58 can be of similar laminated construction. When the cushioning element is disposed with the plane of lamination substantially parallel to the surface of the inner container 14 (FIG. 1), synergistic cushioning properties are observed. More particularly, such laminated cushioning elements are characterized by the property of reducing force transmission and thereby providing improved cushioning of the inner container 14 on impact, compared to the cushioning capability of an otherwise identical foam cushioning elements comprising only a single foamed material of either the first or second density. Stated differently, such laminates are characterized by lower ratios of deceleration protection to static loading.

Preferably, the first and second polymeric foam materials have densities within the range of 0.5–10 Pcf; at least one of the laminated foamed materials is a closed cell foam, the ratio of the densities of the materials is at least 0.66; and at least one of the foamed materials comprises a polyolefin.

The components of the laminate may comprise foams made from polyamides, polyolefins such as polypropylene and polyethylene, polyamides, polyvinyl chloride, polyurethanes, including ester and ether types and various hybrids thereof, and synthetic rubber-like foams such as polydienes. Foams containing fillers or so called "loaded foams" may also be used.

The preferred density and dimensions of the cushioning elements of the invention may vary depending on the weight, size, and fragilities of the articles and packaging containers. For instance, the units can obviously be made larger and of higher density to accommodate higher than normal weights.

In accordance with the present invention it has been found that two standard sizes of cushioning elements cover a wide range of weights of objects to be protected, resulting in a shipping pack of universal adaptation. It has been found that to protect an object weighing 20–75 pounds, the shipping pack should include a side module, a top and bottom module with four corner receiving units on each, all cushioning elements made of 2 PCF polyethylene and the blocks having a length and height of 3 inches and a thickness of 2 inches. Each additional twenty pounds of weight requires one additional cushioning element between the corner receiving units. To accommodate 100–240 pounds, for example, the corner receiving units on the top and bottom module each should be made of 6 PCF polyethylene foam, and the top panels and side blocks should have a 4 inch height and length and a 2 inch thickness. Each additional edge-straddling unit interfitted on the elastomeric cord between each pair of corner receiving units accommodates 50 pounds of added weight. Accordingly, an object having a weight of 430 pounds would require four corner receiving units plus four edge-straddling units.

It will thus be seen that the objects set forth above, among those made apparent from the preceding description are efficiently attained and, since certain changes may be made in the device without departing from the scope of the invention, it is intended that all matter contained in the above description and drawings shall be interpreted as illustrative and not in a limiting sense. Accordingly, other embodiments are within the scope of the following claims.

What is claimed is:

1. A shipping pack for cushionably protecting an object, said pack comprising:

a plurality of shock-absorbing cushioning elements of resilient material defining an integral recess along the length of at least one side thereof, said recess having a restriction of a first dimension and a central portion of a second greater dimension for receiving a cord; and a stretchable continuous elastomeric cord when exhibits resilient elongation during stretching of at least twenty percent and is interfitted within the central portion of said recess and held therein by said restriction;

said plurality of cushioning elements being removably and adjustably positionable in spaced-apart relation along said elastomeric cord, whereby said cord may be stretched manually to surround an object to be protected and said cushioning elements may be adjusted to provide spaced-apart cushioned regions on a said object.

2. The shipping pack of claim 1 in combination with a container housing said object, and, wherein said elastomeric cord is in the form of a loop stretchable around said container, and said cushioning elements comprise a block for placement on a side surface of said container with said internal recess facing away from said container.

3. The shipping pack of claim 1, wherein said cushioning elements comprise of plurality of corner receiving units each including an orthogonal top panel, and two orthogonal blocks forming side panels extending perpendicularly in the same direction from adjacent side edges of said top panel to form an interior cavity.

4. The shipping pack of claim 1, wherein said cushioning elements comprise a plurality of side edge straddling units including a pair of orthogonal blocks joined along the height dimension thereof in perpendicular arrangement to form an interior cavity.

5. The shipping pack of claim 1, wherein said resilient material comprises:

a laminate comprising a first polymeric foam material having a first density adhered to a second polymeric foam material having a different, second density, said laminate being further characterized by the property of reducing the force applied to an object on impact relative to an other-wise identical cushioning element comprising a single foam polymeric material of either said first or second density.

6. The shipping device of claim 5 in combination with a container housing said object, and, wherein said first and second polymeric foam materials are adhered together in a plane substantially parallel to an adjacent surface of said container.

7. The shipping device of claim 5, wherein said first and second polymeric foam materials comprise different polymers.

8. The shipping device in claim 5, wherein the ration of the densities of said first and second polymeric foam materials is at least 0.66.

9. The shipping device of claim 5, wherein at least one of said foamed polymeric materials comprises a polyolefin.

10. The shipping pack of claim 1 wherein said restriction is characterized by an opening having a height less than the cross-sectional diameter of said central portion.

11. The shipping pack of claim 1 wherein said restriction is characterized by an opening having a height less than the cross-sectional diameter of said elastomeric cord.

12. The shipping pack of claim 1 wherein the said elastomeric cord forms a continuous loop.

13. The shipping pack of claim 12 further including means for adjustably fastening the ends of the elastomeric cord together.

* * * * *